US011085012B2

(12) United States Patent
Piorkowski et al.

(10) Patent No.: US 11,085,012 B2
(45) Date of Patent: *Aug. 10, 2021

(54) DETERGENT SINGLE DOSE PACKS AND METHODS OF PRODUCING THE SAME

(71) Applicant: Henkel IP & Holding GmbH, Duesseldorf (DE)

(72) Inventors: Daniel Thomas Piorkowski, Fairfield, CT (US); Casey Elphege Camire, Shelton, CT (US)

(73) Assignee: Henkel IP & Holding GmbH, Duesseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/797,621

(22) Filed: Oct. 30, 2017

(65) Prior Publication Data

US 2019/0127669 A1 May 2, 2019

(51) Int. Cl.

| | |
|---|---|
| ***C11D 17/04*** | (2006.01) |
| ***C11D 3/20*** | (2006.01) |
| ***C11D 1/29*** | (2006.01) |
| ***C11D 3/43*** | (2006.01) |
| ***C11D 1/38*** | (2006.01) |
| ***C11D 3/386*** | (2006.01) |
| ***C11D 1/83*** | (2006.01) |
| ***C11D 3/42*** | (2006.01) |
| ***C11D 1/66*** | (2006.01) |
| ***C11D 1/02*** | (2006.01) |

(52) U.S. Cl.

CPC ..... *C11D 17/042* (2013.01); *C11D 1/02* (2013.01); *C11D 1/29* (2013.01); *C11D 1/38* (2013.01); *C11D 1/66* (2013.01); *C11D 1/83* (2013.01); *C11D 3/2044* (2013.01); *C11D 3/2065* (2013.01); *C11D 3/2068* (2013.01); *C11D 3/386* (2013.01); *C11D 3/42* (2013.01); *C11D 3/43* (2013.01); *C11D 17/043* (2013.01)

(58) Field of Classification Search

CPC .... C11D 1/02; C11D 1/38; C11D 1/66; C11D 1/83; C11D 3/2044; C11D 3/2065; C11D 3/386; C11D 3/42; C11D 17/043

USPC ..... 510/296, 321, 351, 356, 357, 393, 394, 510/439, 505, 506

See application file for complete search history.

(56) References Cited

U.S. PATENT DOCUMENTS

| | | | |
|---|---|---|---|
| 6,037,319 | A | 3/2000 | Dickler et al. |
| 7,259,134 | B2 | 8/2007 | Beckholt et al. |
| 2003/0114332 | A1 | 6/2003 | Ramcharan et al. |
| 2005/0101505 | A1 | 5/2005 | Wood |
| 2011/0112005 | A1 | 5/2011 | Brooker et al. |
| 2012/0135910 | A1 | 5/2012 | Gross et al. |
| 2014/0274859 | A1 | 9/2014 | Adamy |
| 2015/0080561 | A1* | 3/2015 | Torres ..... C09B 29/0059 534/766 |

FOREIGN PATENT DOCUMENTS

| | | | |
|---|---|---|---|
| EP | 2399979 | A1 | 12/2011 |
| EP | 2740785 | A1 | 6/2014 |
| EP | 2865741 | A1 | 4/2015 |
| EP | 3441446 | A1 | 2/2019 |

OTHER PUBLICATIONS

Extended EP Search Report EP 18201718 Completed: Feb. 28, 2019 dated Mar. 8, 2019 8 pages.

* cited by examiner

*Primary Examiner* — Gregory R Delcotto
(74) *Attorney, Agent, or Firm* — Boiuan Deng

(57) ABSTRACT

A single dose pack and methods for producing and using the same are provided. In one embodiment, a single dose pack includes a wash composition encapsulated within a water-soluble container formed from a water-soluble or water-dispersible film. The wash composition includes an ionic detergent surfactant present at from about 5 to about 55 weight percent, water present at from about 5 to about 20 weight percent, glycerol present at from about 3 to about 56 weight percent, polyethylene glycol present at from about 8 to about 56 weight percent, and optionally propylene glycol present at from about 0 to about 35 weight percent, based on a total weight of the wash composition. A sum of the glycerol, the polyethylene glycol, and the propylene glycol is present at from about 22 to about 60 weight percent, based on the total weight of the wash composition.

10 Claims, No Drawings

DETERGENT SINGLE DOSE PACKS AND METHODS OF PRODUCING THE SAME

TECHNICAL FIELD

The technical field relates to detergent packaged in single dose packs and methods of producing the same, and more particularly relates to single dose packs with solvent loadings that are higher than typical and methods of producing the same.

BACKGROUND

Detergent packaged in single dose packs is available for a variety of washing activities, such as clothes laundering and dish washing. The single dose pack provides a premeasured quantity of detergent that is easy to carry and convenient to use. The single dose pack minimizes overdosage of detergent and has proven popular with consumers.

Various forms of detergent single doses are possible, such as the tablet, which has been in use for many years. Early examples of another type of single dose included containers that opened in the wash. The container had to be recovered at the end of the wash, which was inconvenient for the user. Therefore, water soluble films have been provided to eliminate the need for container recovery. Some single dose forms include tablets that utilize disintegrant materials that either swell or dissolve on contact with water. Other tablets use loosely sintered materials coated with a dicarboxylic acid based material for structural integrity. Several different types or forms of detergent single doses are possible.

Many single dose packs include a wash composition that is encapsulated within a film, where the wash composition includes detergent, solvents, and other components useful for cleaning. Consumers are accustomed to a standard size of single dose pack, so changes in the wash composition that reduce the total volume may be compensated for by increasing the solvent loading to maintain a more constant single dose pack size. However, increases in the solvent loading typically result in degradation of the film over time. The film is typically soluble in water, so increases in the water loading have an increased propensity to degrade the film. Water is one solvent often utilized in single dose packs. In some cases, a single dose pack can fail and produce an unpleasant mess, such as when the single dose pack may become "sticky," deformed, or otherwise less attractive to a consumer. In some cases, the film can rupture before use. A ruptured single dose pack can contaminate other single dose packs stored in proximity, so an entire container of single dose packs becomes unpleasant to use.

Typically, liquid laundry detergents with high water contents are not encapsulated in water-soluble films to avoid film degradation during storage. The advantages of liquid laundry detergents over granules, pastes, and gels include aesthetic appearance and quicker delivery to and dispersibility of the detergent in a wash liquor, especially in a cool or cold water washing process.

Including additional solvents in the wash composition also increases the overall size, rigidity, and stability of the single dose pack. The increased size and rigidity results in a single dose pack that is more aesthetically pleasing to handle. Furthermore, increased size and rigidity produces a single dose pack that looks more "full" to consumers, where the single dose pack does not deform or collapse as much during storage.

Accordingly, it is desirable to provide a single dose pack with increased solvent loading where the film remains structurally sound for extended periods, and methods of producing the such single dose packs. In addition, it is desirable to provide single dose packs with non-aqueous solvents that mitigate the water solubility of an encapsulating film, and methods of producing the same. Furthermore, other desirable features and characteristics will become apparent from the subsequent detailed description and the appended claims, taken in conjunction with the accompanying drawings and the foregoing technical field and background.

BRIEF SUMMARY

A single dose pack and methods for producing and using the same are provided. In accordance with one embodiment, a single dose pack includes a water-soluble container and a wash composition encapsulated within the container, wherein the container is formed from a water-soluble or water-dispersible film. Such container may be in the form of pouch. The wash composition includes an ionic detergent surfactant present in an amount of from about 5 to about 55 weight percent, water present in an amount of from about 5 to about 20 weight percent, glycerol present in an amount of from about 3 to about 56 weight percent, polyethylene glycol present in an amount of from about 8 to about 56 weight percent, and optionally propylene glycol present in an amount of from about 0 to about 35 weight percent, based on a total weight of the wash composition. A sum of the glycerol, the polyethylene glycol, and the propylene glycol is present in the wash composition at from about 22 to about 60 weight percent, based on the total weight of the wash composition.

In accordance with another embodiment, a single dose pack includes a water-soluble container, where the container is formed from a film that is soluble or dispersible in water, and wherein the film includes polyvinyl alcohol. A wash composition is encapsulated within the container. The wash composition includes an ionic detergent surfactant present in an amount of from about 5 to about 55 weight percent, water present in an amount of from about 5 to about 20 weight percent, and a non-aqueous solvent with at least three different components. In total, the components of the non-aqueous solvent are present in an amount of at least 1.5 times a concentration of the water, based on the total weight of the wash composition.

In accordance with yet another embodiment a method or producing a single dose pack comprises forming a wash composition that includes an ionic detergent surfactant present in an amount of from about 5 to about 55 weight percent, water present in an amount of from about 5 to about 20 weight percent, glycerol present in an amount of from about 3 to about 56 weight percent, polyethylene glycol present in an amount of from about 8 to about 56 weight percent, and optionally propylene glycol present in an amount of from about 0 to about 35 weight percent, all based on a total weight of the wash composition. A sum of the glycerol, the polyethylene glycol, and the propylene glycol is present in the wash composition at from about 22 to about 60 weight percent, based on the total weight of the wash composition. The wash composition is encapsulated within a water-soluble container to form the single dose pack, where the container is formed from a water-soluble or water-dispersible film.

DETAILED DESCRIPTION

The following detailed description is merely exemplary in nature and is not intended to limit the single dose pack, or the method for producing or using the same. Furthermore, there is no intention to be bound by any theory presented in the preceding background or the following detailed description.

The term "about" as used in connection with a numerical value throughout the specification and the claims denotes an interval of accuracy, familiar and acceptable to a person skilled in the art. In general, such interval of accuracy is ±10%. Thus, "about ten" means 9 to 11. All numbers in this description indicating amounts, ratios of materials, physical properties of materials, and/or use are to be understood as modified by the word "about," except as otherwise explicitly indicated.

Reference numbers are utilized for in this description for clarity, where the terms and associated reference numbers are: single dose 20; wash composition 12; film 14; water 16; non-aqueous solvent 18; glycerol 20; 4C+ compound 22; propylene glycol 24; ionic detergent surfactant 30; nonionic detergent surfactant 32; enzyme 34; peroxy compounds 36; bleach activators 38; anti-redeposition agents 40; neutralizers 42; optical brighteners 44; foam inhibitors 46; chelators 48; bittering agent 50; mixer 60; and sealer 62. These terms are described more fully below.

A single dose pack 10 is formed by encapsulating a wash composition 12 within a water soluble container, where the container is formed from a film 14. In some embodiments, the film 14 forms one half or more of the container, where the container may also include dyes, print, or other components in some embodiments. The film 14 is water soluble or water dispersible such that the film 14 will completely dissolve when an exterior of the film 14 is exposed to water, such as in a washing machine typically used for laundry. When the film 14 dissolves, the container is ruptured and the contents are released. As used herein, "water soluble" or "water dispersible" means at least 2 grams of the solute (the film 14 in one example) will dissolve in 5 liters of solvent (water in one example) for a solubility of at least 0.4 grams per liter (g/l), at a temperature of 25 degrees Celsius (° C.) unless otherwise specified. Suitable films 14 for packaging are rapidly and completely soluble in water at temperatures of about 5° C. or greater.

The film 14 is desirably strong, flexible, shock resistant, and non-tacky during storage at both high and low temperatures and high and low humidities. In an exemplary embodiment, the film 14 is initially formed from polyvinyl acetate, and at least a portion of the acetate functional groups are hydrolyzed to produce alcohol groups. Therefore, the film 14 includes polyvinyl alcohol (PVOH), and may include a higher concentration of PVOH than polyvinyl acetate. Such films 14 are commercially available with various levels of hydrolysis, and thus various concentrations of PVOH, and in an exemplary embodiment the film 14 initially has about 85 percent of the acetate groups hydrolyzed to alcohol groups. Some of the acetate groups may further hydrolyze in use, so the final concentration of alcohol groups may be higher than the concentration at the time of packaging. The film 14 may have a thickness of from about 25 to about 200 microns (μm), or from about 45 to about 100 μm, or from about 75 to about 90 μm in various embodiments. The film 14 may include alternate materials in some embodiments, such as methyl hydroxy propyl cellulose and polyethylene oxide, but the film 14 is water soluble in all embodiments.

The single dose pack 10 may be formed from a water-soluble container having a single section, but the single dose pack 10 may be formed from containers with two or more different sections in alternate embodiments. In embodiments with a container having two or more sections, the contents of the different sections may or may not the same. In some embodiments, the single dose pack 10 is formulated and configured for cleaning laundry, but other cleaning purposes are also possible. The wash composition 12 is positioned within the container, and the container is sealed to encase and enclose the wash composition 12. The wash composition 12 is typically in direct contact with the film 14 of the container within the single dose pack 10. The film 14 of the container is sealable by heat, heat and water, ultrasonic methods, or other techniques, and one or more sealing techniques may be used to enclose the wash composition 12 within the container.

In an exemplary embodiment, the wash composition 12 is liquid when encapsulated within the container. The liquid wash composition 12 has a viscosity of from about 100 to about 1,000 centipoise, or from about 100 to 300 centipoise in different embodiments, where "viscosity," as used herein, means the viscosity measured by a rotational viscometer at a temperature of 25 degrees Celsius (° C.) The liquid form facilitates rapid delivery and dispersion of the wash composition 12 once the container ruptures, and this rapid dispersion can aid cleaning. In an exemplary embodiment, the single dose pack 10 is sized to provide a desired quantity of wash composition 12 for one load of laundry or one batch of dishes in a dishwasher. The single dose pack 10 may also be sized for a fraction of a desired quantity, such as one half of a load of laundry, so a user can adjust the amount of detergent added without having to split a single dose pack 10. In an exemplary embodiment, the single dose pack 10 has a weight of from about 5 to about 50 grams. In alternate embodiments, the single dose pack 20 is from about 10 to about 40 grams, or from about 20 to about 30 grams.

A single dose pack 10 that includes the concentrations of solvents describe herein may be more likely to have favorable pack haptics, film stability, and desirable dissolution rates. A percent pack height loss is a ratio of a change in pack height (original pack height minus a final pack height after storage) to the original pack height. Single dose packs 10 tend to lose some pack height with storage, and the percent pack height loss is a good indication of the haptics of the pack. A single dose pack 10 with a low percent pack height loss has a more appealing appearance to a user, where a package with several single dose packs 10 looks fuller and each single dose pack 10 appears fresher and more appealing. The concentrations of water 16 and non-aqueous solvents 18 as described herein has a significant effect on the percent pack height loss, where the percent pack height loss may about 25% or less for the concentrations as described above. Examples with comparable concentrations of water and with no C4+ compound 22 or with less C4+ compound 22 than as described above may have pack height losses of 50% or more. The % pack height loss, as described herein, is based on a storage time of about 2 months at a storage temperature of about 24° C.

A plurality of components are combined to form a wash composition 12, where the wash composition 12 is typically prepared prior to encapsulated within the container. The plurality of components include water 16, and as mentioned above the film 14 is soluble in water 16. The film 14 remains structurally sound and intact prior to use of the single dose pack 10, where the single dose pack 10 is immersed in a large quantity of water in use. A "large" quantity of water is at least about 100 times the weight of the single dose pack 10. For example, a single dose pack 10 having a weight of from about 5 to about 50 grams may be immersed in from about 10 to about 50 liters of water in use. As used herein, "structurally sound" means the container and the film 14 do not rupture or leak under typical storage conditions, such as about 0.5 to about 1.5 atmospheres of pressure, temperatures of about −10 to about 35° C., and a relative humidity of about 1 to about 80% for a period of at least 1 week. Structurally sound also means the container and the film 14 are not tacky or sticky to the touch.

Water 16 is included in the wash composition 12 at a concentration of from about 2 to about 20 weight percent, or present in an amount of from about 5 to about 20 weight percent, or present in an amount of from about 10 to about 20 weight percent, or present in an amount of from about 15 to about 20 weight percent in various embodiments, based on a total weight of the wash composition 12. Water 16 may be added to the wash composition 12 directly or as a component of other ingredients, or directly and as a component of other ingredients.

The solubility of the film 14 in water 16 should be moderated to keep the film 14 structurally sound prior to use. The water 16 in the wash composition 12 directly contacts the film 14 in the single dose pack 10 in many embodiments. However, the addition of certain other components in the wash composition 12 can moderate the solubility of the film 14 and thereby protect the film 14 from dissolving in the water 16 incorporated in the wash composition 12. It has been found that the inclusion of some non-aqueous solvents 18 in the wash composition 12 does moderate the solubility of the film 14. As such, adding the non-aqueous solvent 18 to the wash composition 12 allows for single dose packs 10 where the wash composition 12 includes water 16 present in amounts of up to about 20 weight percent, based on the total weight of the wash composition 12, and where the film 14 remains structurally sound during storage for a time period of from about 1 month to about 24 months or more. Structurally sound also means the film is not tacky or sticky to the touch.

A solvent is a component that is utilized as a carrier in a formulation, where other components (solutes) are dissolved in the solvent. Solvents generally solvate solutes and act as bulk fillers for the formula when used below a certain use-level so as to not plasticize the film 14. Specific criteria that precisely and exactly define what is or is not a solvent are difficult to define, because some components may have more than one purpose. Generally, solvents for liquid formulations are liquids at standard conditions (i.e., 1 atmosphere pressure and 20° C.). Typically, detergent surfactants, optical brighteners, dyes or other colorants, bleach agents or activators, enzymes, perfumes or other ingredients added for odor purposes, bittering agents, peroxy compounds, soil release agents, dye transfer inhibitors, foam inhibitors, chelators or other water softeners are not considered "solvents." For the sake of clarity, the term "solvent," as used herein, is expressly limited to one or more of: water; glycerol; propylene glycol; ethylene glycol; ethanol, and a 4C+ compound. The "4C+ compound" is expressly limited to one or more of: polyethylene glycol; polypropylene glycol; polyethylene glycol esters such as polyethylene glycol stearate, propylene glycol laurate, and/or propylene glycol palmitate; methyl ester ethoxylate; diethylene glycol; dipropylene glycol; sorbitol; tetramethylene glycol; butylene glycol; pentanediol; hexylene glycol; heptylene glycol; octylene glycol; 2-methyl, 1,3 propanediol; xylitol; mannitol; erythritol; dulcitol; inositol; adonitol; triethylene glycol; polypropylene glycol; glycol ethers, such as ethylene glycol monobutyl ether, diethylene glycol monobutyl ether, triethylene glycol monobutyl ether, ethylene glycol monopropyl ether, diethylene glycol monoethyl ether, triethylene glycol monoethyl ether, diethylene glycol monomethyl ether, and triethylene glycol monomethyl ether; tris (2-hydroxyethyl) methyl ammonium methylsulfate; ethylene oxide/propylene oxide copolymers with a number average molecular weight of 3,500 Daltons or less; and ethoxylated fatty acids. 4C+ generally refers to a compound with 4 or more carbon atoms, but the 4C+ compound, in this description, is expressly limited to the compounds mentioned above.

The compound suitable for preparing the ethoxylated fatty acid may be a linear or branched alcohol wherein a hydroxyl group is connected to an ethylene group. Diols with two hydroxyl groups attached to separate carbon atoms in an aliphatic chain may also be used, as long as at least one of the hydroxyl groups is connected to an ethylene group. Polyols, such as polyethylene glycol, or copolymers, such as ethylene oxide/propylene oxide (EO/PO), may also be suitable to prepare the ethoxylated fatty acid, as long as the polymers or copolymers provide an ethoxyl functional group. An exemplary polyol is polyethylene glycol (PEG), and in some embodiments the polyethylene glycol includes from about 8 to about 125 ethylene glycol units. According to a preferred embodiment, the ethoxylated fatty acid is PEG stearate, fatty methyl ester ethoxylate, or PEG laurate. A preferred fatty methyl ester ethoxylate is C18 methyl ester ethoxylate 10EO. Fatty acids suitable for preparing the ethoxylated fatty acid include carboxylic acids with a long aliphatic tail having a total of from 8 to 25 carbons, or from 11 to 20 carbons, or from 12 to 18 carbons, and or even from 14 to 18 carbons. The fatty acid can be saturated, monounsaturated, di-unsaturated, or poly-unsaturated fatty acids. In some embodiments, the fatty acid is hexanoic acid, heptanoic acid, octanoic acid, nonanoic acid, capric acid, undecanoic acid, dodecanoic acid (lauric acid), tridecanoic acid, myristic acid, pentadecanoic acid, palmitic acid, heptadecanoic acid, stearic acid, nonadecanoic acid, eicosanoic acid, heneicosanoic acid, docosanoic acid, myristoleic acid, palmitoleic acid, sapienic acid, oleic acid, elaidic acid, vaccenic acid, linoleic acid, linoelaidic acid, arachidonic acid, eicosapentaenoic acid, erucic acid, docosahexaenoic acid, or a mixture thereof. In other embodiments, the fatty acid is selected from the group consisting of arachidic acid, arachidonic acid, lauric acid, decanoic acid, caprylic acid, myristic acid, palmitic acid, palmitoleic acid, stearic acid, oleic acid, linoleic acid, and mixtures thereof. In exemplary embodiments, the fatty acid is stearic acid or lauric acid. In another exemplary embodiment, the fatty acid is stearic acid.

The non-aqueous solvent 18 includes two, three, or more components, including at least one component that is not typically utilized in single dose packs 10, where the components in the non-aqueous solvent 18 are strictly limited to those compounds and/or categories described above for the non-aqueous solvent 18. The non-aqueous solvent 18 includes glycerol 20, a 4C+ compound 22, and optionally propylene glycol 24. The 4C+ compound 22 may include polypropylene glycol, which is not to be confused with propylene glycol 24. Propylene glycol 24 has 3 carbon atoms, and polypropylene glycol is a polymer that has more than 3 carbon atoms.

Testing has indicated that a sufficient concentration of the proper combination of the above mentioned individual non-aqueous solvents does in fact moderate the solubility of the film 14 in water 16 such that a liquid wash composition 12 with a water concentration of up to about 20 weight percent (based on the total weight of the wash composition 12) is possible. The non-aqueous solvent 18 is included in the wash composition 12 at amounts of from about 20 to about 50 weight percent, or amounts of from about 25 to about 50 weight percent, or amounts of from about 30 to about 50 weight percent in various embodiments, based on the total weight of the wash composition 12. In an exemplary embodiment, the non-aqueous solvent 18 is present in the wash composition 12 in amounts of from about 22 to about 65 weight percent, based on the total weight of the wash composition 12, where the total amount of non-aqueous solvent 18 may include materials added as constituents of other ingredients. For example, some ingredients may include ethyl alcohol, which is a non-aqueous solvent but may not be added for the purpose of moderating the solubility of the film 14. In some embodiments, a non-aqueous solvent sum of the glycerol 20, the 4C+ compound 22 (such as polypropylene glycol or other 4C+ compounds 22), and the propylene glycol 24 is within the range of the non-aqueous solvent 18 described above, and may be from about 22 to about 60 weight percent, based on the total weight of the wash composition 12. A total solvent sum of the non-aqueous solvents 18 and the water 16 may be present in the wash composition 12 at amounts of from about 30 to about 70 weight percent, or amounts of from about 33 to about 55 weight percent, or amounts of from about 35 to about 50 weight percent in various embodiments, based on the total weight of the wash composition 12. In some embodiments, the concentration of the non-aqueous solvent 18, in weight percent based on the total weight of the wash composition 12, is at least about 1.5 times the concentration of water 16, in weight percent based on the total weight of the wash composition 12. Not to be bound by theory, but the higher concentration of the non-aqueous solvent 18 relative to the concentration of the water 16 may aid in moderating the solubility of the film 14 in the water 16.

The non-aqueous solvent 18 includes glycerol present in an amount of from about 10 to about 80 weight percent, or from about 10 to about 66 weight percent, or from about 20 to about 63 weight percent, based on a total weight of the non-aqueous solvent 18, in various embodiments. The non-aqueous solvent 18 also includes the 4C+ compound 22, such as polyethylene glycol, present in an amount of from about 25 to about 80 weight percent, or from about 28 to about 80 weight percent, or from about 33 to about 70 weight percent, based on the total weight of the non-aqueous solvent 18, in various embodiments. The 4C+ compound 22 is one or more of: polyethylene glycol; polypropylene glycol; polyethylene glycol esters such as polyethylene glycol stearate, polyethylene glycol laurate, and/or polyethylene glycol palmitate; methyl ester ethoxylate; and glycols with 5 or more carbons such as pentylene glycol and hexylene glycol in various embodiments; as mentioned above. In some embodiments, the 4C+ compound 22 is polyethylene glycol with a number average molecular weight of from about 100 to about 10,000 Daltons, or from about 150 to about 5,000 Daltons, or from about 200 to about 1,000 Daltons, or from about 300 to about 800 Daltons in various embodiments, but alternate number average molecular weights are also possible. Propylene glycol 24 is optionally present in the non-aqueous solvent 18 present in an amount of from about 0 to about 50 weight percent, or from about 0 to about 40 weight percent, or from about 3 to about 33 weight percent, based on the total weight of the non-aqueous solvent 18, in various embodiments. As such, the non-aqueous solvent 18 includes two or more compounds in some embodiments, but the non-aqueous solvent 18 includes three or more compounds in other embodiments.

The concentration of the individual non-aqueous solvents 18 in the wash composition 12 can be determined by multiplying the concentration of the individual solvent within the non-aqueous solvent 18 by the concentration of the non-aqueous solvent 18 in the wash composition 12. For example, if the non-aqueous solvent 18 is present in the wash composition 12 in an amount of from about 30 to about 70 percent, and glycerol 20 is present in the non-aqueous solvent 18 in an amount of from about 10 to about 80 percent, then glycerol 20 is present in the wash composition 12 in an amount of from about (0.3×0.1=0.03, or 3 percent) to about (0.7×0.8=0.56, or 56 percent) weight percent, based on the total weight of the wash composition 12. Using this basic math and the concentrations listed above, we can see that glycerol 20 is present in the wash composition 12 in an amount of from about 3 to about 56 weight percent; or from about 3 to about 46 weight percent; or from about 6 to about 44 weight percent; or from about 3 to about 44 weight percent; or from about 3 to about 36 weight percent; or from about 7 to about 35 weight percent; or from about 4 to about 40 weight percent; or from about 4 to about 33 weight percent; or from about 7 to about 32 weight percent; or from about 4 to about 34 weight percent; or from about 4 to about 28 weight percent; or from about 7 to about 26 weight percent; in various embodiments, all based on the total weight of the wash composition 12.

In a similar manner, it can be shown that the 4C+ compound 22 is present in the wash composition 12 in an amount of from about 7 to about 56 weight percent; or from about 8 to about 56 weight percent; or from about 10 to about 49 weight percent; or from about 8 to about 44 weight percent; or from about 9 to about 44 weight percent; or from about 11 to about 39 weight percent; or from about 9 to about 40 weight percent; or from about 10 to about 40 weight percent; or from about 12 to about 35 weight percent; or from about 9 to about 34 weight percent; or from about 10 to about 34 weight percent; or from about 12 to about 29 weight percent; in various embodiments, all based on the total weight of the wash composition 12.

Using the same math concepts, it can be shown that propylene glycol 24 is present in the wash composition 12 in an amount of from about 0 to about 35 weight percent; or from about 0 to about 28 weight percent; or from about 1 to about 23 weight percent; or from about 0 to about 28 weight percent; or from about 0 to about 22 weight percent; or from about 1 to about 18 weight percent; or from about 0 to about 25 weight percent; or from about 0 to about 20 weight percent; or from about 1 to about 17 weight percent; or from about 0 to about 21 weight percent; or from about 0 to about 17 weight percent; or from about 1 to about 14 weight percent; in various embodiments, all based on the total weight of the wash composition 12.

A balance of the different components of the non-aqueous solvent 18 has been found to mitigate the water solubility of the film 14. The concentration of any one component of the non-aqueous solvent 18 may not provide the desired mitigation of the film solubility in water 16, but the combined concentrations of two, three or more of the components of the non-aqueous solvents 18 may provide the desired film solubility mitigation. As such, there appears to be some sort of combination or synergistic effect of the different components of the non-aqueous solvent 18, where the combination or synergistic effect is valuable for the overall single dose pack 10.

The wash composition 12 includes other components as well. For example, the wash composition 12 includes an ionic detergent surfactant 30, where the ionic detergent surfactant 30 is formulated for laundry in an exemplary embodiment. The ionic detergent surfactant 30 may include one or more surfactants, including cationic and/or anionic surfactants, in various embodiments. The ionic detergent surfactant 30 may be present in the wash composition 10 at a concentration of from about 5 to about 55 weight percent in one embodiment, but the ionic detergent surfactant 30 may be present in the wash composition 12 at a concentration of about 10 to about 30 weight percent or from about 20 to about 25 weight percent in alternate embodiments, where weight percents are based on a total weight of the wash composition 10.

Suitable ionic detergent surfactants 30 that are anionic include soaps which contain sulfate or sulfonate groups, including those with alkali metal ions as cations. Usable soaps include alkali metal salts of saturated or unsaturated fatty acids with 12 to 18 carbon (C) atoms. Such fatty acids may also be used in incompletely neutralized form. Usable ionic detergent surfactants 30 of the sulfate type include the salts of sulfuric acid semi esters of fatty alcohols with 12 to 18 C atoms, and/or alcohol ethoxysulfates. Usable ionic detergent surfactants 30 of the sulfonate type include alkane sulfonates with 12 to 18 C atoms and olefin sulfonates with 12 to 18 C atoms, such as those that arise from the reaction of corresponding mono-olefins with sulfur trioxide, alpha-sulfofatty acid esters such as those that arise from the sulfonation of fatty acid methyl or ethyl esters, and lauryl ether sulfates. In an exemplary embodiment, the wash composition 12 is free of linear alkyl benzene sulfonic acid surfactants, such as linear alkylbenzene sulfonates with 9 to 14 C atoms in the alkyl moiety. As used herein, "substantially free of" means the named component is present in an amount of about 0.001 weight percent or less, based on a total weight of the named composition (such as the wash composition 12). The linear alkyl benzene sulfonic acid surfactants may cause "yellowing," which is undesirable.

Suitable ionic detergent surfactants 30 that are cationic may include textile-softening substances of the general formula X, XI, or XII as illustrated below:

(X)

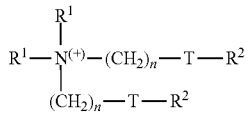

(XI)

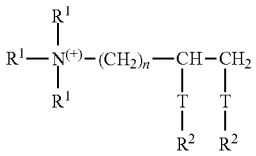

(XII)

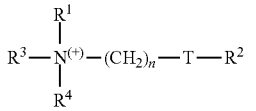

in which each $R^1$ group is mutually independently selected from among $C_{1-6}$ alkyl, alkenyl or hydroxyalkyl groups; each $R^2$ group is mutually independently selected from among $C_{8-28}$ alkyl or alkenyl groups; $R^3$=$R^1$ or $(CH_2)_n$-T-$R^2$; $R^4$=$R^1$ or $R^2$ or $(CH_2)_n$-T-$R^2$; T=—$CH_2$—, —O—CO—, or —CO—O—, and n is an integer from 0 to 5. The ionic detergent surfactants 30 that are cationic may include conventional anions of a nature and number required for charge balancing. Alternatively, the ionic detergent surfactant 30 may include anionic detergent surfactants that may function to balance the charges with the cationic detergent surfactants. In some embodiments, ionic detergent surfactants 30 that are cations may include hydroxyalkyltrialkylammonium compounds, such as $C_{12-18}$ alkyl(hydroxyethyl) dimethyl ammonium compounds, and may include the halides thereof, such as chlorides or other halides. The ionic detergent surfactants 30 that are cations may be especially useful for compositions intended for treating textiles.

Nonionic detergent surfactants 32 may optionally be present in the wash composition 12 at a concentration of from about 0 to about 60 weight percent, or from about 5 to about 50 weight percent, or from about 20 to about 40 weight percent in various embodiments. Suitable nonionic detergent surfactants 32 include alkyl glycosides and ethoxylation and/or propoxylation products of alkyl glycosides or linear or branched alcohols in each case having 12 to 18 C atoms in the alkyl moiety and 3 to 20, or 4 to 10, alkyl ether groups. Corresponding ethoxylation and/or propoxylation products of N-alkylamines, vicinal diols, fatty acid esters and fatty acid amides, which correspond to the alkyl moiety in the stated long-chain alcohol derivatives, may furthermore be used. Alkylphenols having 5 to 12 C atoms may also be used in the alkyl moiety of the above described long-chain alcohol derivatives.

Several other components may optionally be added to and included in the wash composition 12, including but not limited to enzymes 34, peroxy compounds 36, bleach activators 38, anti-redeposition agents 40, neutralizers 42, optical brighteners 44, foam inhibitors 46, chelators 48, bittering agents 50, dye transfer inhibitors, soil release agents, water softeners, and other components. A partial, non-exclusive list of additional components (not illustrated) that may be added to and included in the wash composition 12 include electrolytes, pH regulators, graying inhibitors, anti-crease components, bleach agents, colorants, scents, processing aids, antimicrobial agents, and preservatives.

Possible enzymes 34 that may be in the wash composition 12 contemplated herein include one or more of a protease, lipase, cutinase, amylase, carbohydrase, cellulase, pectinase, mannanase, arabinase, galactanase, xylanase, oxidase, (e.g., a laccase), and/or peroxidase, but others are also possible. In general, the properties of the selected enzyme(s) 34 should be compatible with the selected wash composition 12, (i.e., pH-optimum, compatibility with other enzymatic and non-enzymatic ingredients, etc.). The detergent enzyme(s) 34 may be included in the wash composition 12 by adding separate additives containing one or more enzymes 34, or by adding a combined additive comprising all the enzymes 34 that are added to the wash composition 12. The enzyme(s) 34 should be present in the wash composition 12 in effective amounts, such as from about 0 weight percent to about 5 weight percent of enzyme 34, or from about 0.001 to about 5 weight percent, or from about 0.2 to about 2 weight percent, or from about 0.5 to about 1 weight percent, based on the total weight of the wash composition 12, in various embodiments.

As alluded to above, a peroxy compound 36 may optionally be present in the wash composition 12. Exemplary peroxy compounds 36 include organic peracids or peracidic salts of organic acids, such as phthalimidopercaproic acid, perbenzoic acid or salts of diperdodecanedioic acid, hydrogen peroxide and inorganic salts that release hydrogen peroxide under the washing conditions, such as perborate, percarbonate and/or persilicate. Hydrogen peroxide may also be produced with the assistance of an enzymatic system, i.e. an oxidase and its substrate. Other possible peroxy compounds 36 include alkali metal percarbonates, alkali metal perborate monohydrates, alkali metal perborate tetrahydrates or hydrogen peroxide. Peroxy compounds 36 may be present in the wash composition 12 at an amount of from about 0 to about 50 weight percent, or an amount of from about 3 to about 30 weight percent, or an amount of from about 3 to about 10 weight percent, based on the total weight of the wash composition 12, in various embodiments.

Bleach activators 38 may optionally be added and included in the wash composition 12. Conventional bleach activators 38 that form peroxycarboxylic acid or peroxyimidic acids under perhydrolysis conditions and/or conventional bleach-activating transition metal complexes may be used. The bleach activator 38 optionally present may include, but is not limited to, one or more of: N- or O-acyl compounds, for example polyacylated alkylenediamines, such as tetraacetylethylenediamine; acylated glycolurils, such as tetraacetylglycoluril; N-acylated hydantoins; hydrazides; triazoles; urazoles; diketopiperazines; sulfurylamides and cyanurates; carboxylic anhydrides, such as phthalic anhydride; carboxylic acid esters, such as sodium isononanoylphenolsulfonate; acylated sugar derivatives, such as pentaacetyl glucose; and cationic nitrile derivatives such as trimethylammonium acetonitrile salts.

To avoid interaction with peroxy compounds during storage, the bleach activators 38 may be coated with shell substances or granulated prior to addition to the wash composition 12, in a known manner. As such, the bleach activator 38 and/or other components may be present in a liquid wash composition 12 as a free or floating particulate. Exemplary embodiments of the coating or shell substance include tetraacetylethylenediamine granulated with the assistance of carboxymethylcellulose and having an average grain size of 0.01 mm to 0.8 mm, granulated 1,5-diacetyl-2,4-dioxohexahydro-1,3,5-triazine, and/or trialkylammonium acetonitrile formulated in particulate form. In various embodiments, the bleach activators 38 may be present in the wash composition 12 in quantities of from about 0 to about 8 weight percent, or from about 0 to about 6 weight percent, or from about 0 to about 4 weight percent, in each case relative to the total weight of the wash composition 12.

One or more anti-redeposition agents 40 may also be optionally included in the wash composition 12. Anti-redeposition agents 40 include polymers with a soil detachment capacity, which are also known as "soil repellents" due to their ability to provide a soil-repelling finish on the treated surface, such as a fiber. Anti-redeposition agents 40 include polymers with a soil detachment capacity. One example in regard to polyesters includes copolyesters prepared from dicarboxylic acids, such as adipic acid, phthalic acid or terephthalic acid. In an exemplary embodiment, an anti-redeposition agents 40 includes polyesters with a soil detachment capacity that include those compounds which, in formal terms, are obtainable by esterifying two monomer moieties, the first monomer being a dicarboxylic acid HOOC-Ph-COOH and the second monomer a diol HO—$(CHR^{11}—)_a$OH, which may also be present as a polymeric diol H—$(O—(CHR^{11}—)_a)_b$OH. Ph here means an ortho-, meta- or para-phenylene residue that may bear 1 to 4 substituents selected from alkyl residues with 1 to 22 C atoms, sulfonic acid groups, carboxyl groups and mixtures thereof. $R^{11}$ means hydrogen or an alkyl residue with 1 to 22 C atoms and mixtures thereof "a" means a number from 2 to 6 and "b" means a number from 1 to 300. The polyesters obtainable therefrom may contain not only monomer diol units —O—$(CHR^{11}—)_a$O— but also polymer diol units —$(O—(CHR^{11}—)_a)_b$O—. The molar ratio of monomer diol units to polymer diol units may amount to from about 100:1 to about 1:100, or from about 10:1 to about 1:10 in another embodiment. In the polymer diol units, the degree of polymerization "b" may be in the range of from about 4 to about 200, or from about 12 to about 140 in an alternate embodiment. The average molecular weight of the polyesters with a soil detachment capacity may be in the range of from about 250 to about 100,000, or from about 500 to about 50,000 in an alternate embodiment. The acid on which the residue Ph is based may be selected from terephthalic acid, isophthalic acid, phthalic acid, trimellitic acid, mellitic acid, the isomers of sulfophthalic acid, sulfoisophthalic acid and sulfoterephthalic acid and mixtures thereof. Where the acid groups thereof are not part of the ester bond in the polymer, they may be present in salt form, such as an alkali metal or ammonium salt. Exemplary embodiments include sodium and potassium salts.

If desired, instead of the monomer HOOC-Ph-COOH, the polyester with a soil detachment capacity (the anti-redeposition agent 40) may include small proportions, such as no more than about 10 mole percent relative to the proportion of Ph with the above-stated meaning, of other acids that include at least two carboxyl groups. These include, for example, alkylene and alkenylene dicarboxylic acids such as malonic acid, succinic acid, fumaric acid, maleic acid, glutaric acid, adipic acid, pimelic acid, suberic acid, azelaic acid and sebacic acid. Exemplary diols HO—$(CHR^{11}—)_a$OH include those in which $R^{11}$ is hydrogen and "a" is a number of from about 2 to about 6, and in another embodiment includes those in which "a" has the value of 2 and $R^{11}$ is selected from hydrogen and alkyl residues with 1 to 10 C atoms, or where $R^{11}$ is selected from hydrogen and alkyl residues with 1 to 3 C atoms in another embodiment. Examples of diol components are ethylene glycol, 1,2-propylene glycol, 1,3-propylene glycol, 1,4-butanediol, 1,5-pentanediol, 1,6-hexanediol, 1,8-octanediol, 1,2-decanediol, 1,2-dodecanediol and neopentyl glycol. The polymeric diols include polyethylene glycol with an average molar mass in the range from about 1000 to about 6000. If desired, these polyesters may also be end group-terminated, with end groups that may be alkyl groups with 1 to 22 C atoms or esters of monocarboxylic acids. The end groups attached via ester bonds may be based on alkyl, alkenyl and aryl monocarboxylic acids with 5 to 32 C atoms, or with 5 to 18 C atoms in another embodiment. These include valeric acid, caproic acid, enanthic acid, caprylic acid, pelargonic acid, capric acid, undecanoic acid, undecenoic acid, lauric acid, lauroleic acid, tridecanoic acid, myristic acid, myristoleic acid, pentadecanoic acid, palmitic acid, stearic acid, petroselinic acid, petroselaidic acid, oleic acid, linoleic acid, linolaidic acid, linolenic acid, eleostearic acid, arachidic acid, gadoleic acid, arachidonic acid, behenic acid, erucic acid, brassidic acid, clupanodonic acid, lignoceric acid, cerotic acid, melissic acid, benzoic acid, which may bear 1 to 5 substituents having a total of up to 25 C atoms, or 1 to 12 C atoms in another embodiment, for example tert-butylbenzoic acid. The end groups may also be based on hydroxymonocarboxylic acids with 5 to 22 C atoms, which for example include hydroxyvaleric acid, hydroxycaproic acid, ricinoleic acid, the hydrogenation product thereof, hydroxystearic acid, and ortho-, meta- and para-hydroxybenzoic acid. The hydroxymonocarboxylic acids may in turn be joined to one another via their hydroxyl group and their carboxyl group and thus be repeatedly present in an end group. The number of hydroxymonocarboxylic acid units per end group, i.e. their degree of oligomerization, may be in the range of from 1 to 50, or in the range of from 1 to 10 in another embodiment. In an exemplary embodiment, polymers of ethylene terephthalate and polyethylene oxide terephthalate, in which the polyethylene glycol units have molar weights of from about 750 to about 5000 and the molar ratio of ethylene terephthalate to polyethylene oxide terephthalate of from about 50:50 to about 90:10, are used alone or in combination with cellulose derivatives. The anti-redeposition agent 40 is present in the wash composition 12 at an amount of from about 0 to about 3 weight percent, or an amount of from about 0 to about 2 weight percent, or an amount of from about 0 to about 1 weight percent, based on the total weight of the wash composition 12, in various embodiments.

Neutralizers 42 are optionally added to and included in the wash composition 12. Exemplary neutralizers 42 include, but are not limited to, sodium hydroxide, triethanol amine, monoethanol amine, buffers, or other compounds that adjusts the pH of the wash composition 12. Neutralizers 42 may be present in the wash composition 12 at an amount of from about 0 to about 5 weight percent in some embodiments, based on the total weight of the wash composition 12, but in other embodiments the neutralizer 42 may be present in the wash composition 12 at an amount of from about 0 to about 3 weight percent, or an amount of from about 0 to about 2 weight percent, based on the total weight of the wash composition 12.

Optical brighteners 44 may optionally be included in the wash composition 12. Optical brighteners 44 adsorb ultraviolet and/or violet light and re-transmit it as visible light, typically a visible blue light. Optical brighteners 44 include, but are not limited to, derivatives of diaminostilbene disulfonic acid or the alkali metal salts thereof. Suitable compounds are, for example, salts of 4,4'-bis(2-anilino-4-morpholino-1,3,5-triazinyl-6-amino)stilbene 2,2'-disulfonic acid or compounds of similar structure which, instead of the morpholino group, bear a diethanolamino group, a methylamino group, an anilino group or a 2-methoxyethylamino group. Optical brighteners 44 of the substituted diphenylstyryl type may furthermore be present, such as the alkali metal salts of 4,4'-bis(2-sulfostyryl)diphenyl, 4,4'-bis(4-chloro-3-sulfostyryl)diphenyl, or 4-(4-chlorostyryl)-4'-(2-sulfostyryl)diphenyl. Mixtures of the above-stated optical brighteners 44 may also be used. Optical brighteners 44 may be present in the wash composition 12 at an amount of from about 0 to about 1 weight percent in some embodiments, but in other embodiments optical brighteners 42 are present in an amount of from about 0.01 to about 0.5 weight percent, or an amount of from about 0.05 to about 0.3 weight percent, or an amount of from 0.005 to about 5 weight percent, based on the total weight of the wash composition 12.

Foam inhibitors 46 may also optionally be included in the wash composition 12. Suitable foam inhibitors 46 include, but are not limited to, soaps of natural or synthetic origin, which include an elevated proportion of $C_{18}$-$C_{24}$ fatty acids. Suitable non-surfactant foam inhibitors 46 are, for example, organopolysiloxanes and mixtures thereof with microfine, optionally silanized silica as well as paraffins, waxes, microcrystalline waxes and mixtures thereof with silanized silica or bis-fatty acid alkylenediamides. Mixtures of different foam inhibitors 46 may also be used, for example mixtures of silicones, paraffins or waxes. In an exemplary embodiment, mixtures of paraffins and bistearylethylenediamide may be used. The wash composition 12 may include the foam inhibitor 46 at an amount of from about 0 to about 5 weight percent, but in other embodiments the foam inhibitor 44 may be present at an amount of from about 0.05 to about 3 weight percent, or an amount of from about 0.5 to about 2 weight percent, based on the total weight of the wash composition 12.

Chelators 48 bind and remove calcium, magnesium, or other metals from water, and may optionally be included in the wash composition 12. Many compounds can be used as water softeners 48, including but not limited to ethylenediaminetetraacetic acid (EDTA), nitrilotriacetic acid, diethylenetriaminepenta(methylenephosphonic acid), nitrilotris(methylenephosphonic acid), 1-hydroxyethane-1,1-diphosphonic acid, iminodisuccinic acid (IDS), or other chelating agents. Chelators 48 may be present in the wash composition 12 at an amount of from about 0 to about 5 weight percent in an exemplary embodiment, but in alternate embodiments the chelators 48 are present at an amount of from about 0.01 to about 3 weight percent or an amount of from about 0.02 to about 1 weight percent, based on the total weight of the wash composition 12.

Bittering agents 50 may optionally be added to hinder accidental ingestion of the single dose pack 10 or the wash composition 12. Bittering agents 50 are compositions that taste bad, so children or others are discouraged from accidental ingestion. Exemplary bittering agents 50 include denatonium benzoate, aloin, and others. Bittering agents 50 may be present in the wash composition 12 at an amount of from about 0 to about 1 weight percent, or an amount of from about 0 to about 0.5 weight percent, or an amount of from about 0 to about 0.1 weight percent in various embodiments, based on the total weight of the wash composition 12.

The components of the wash composition 12 are combined and mixed together with a mixer 60. Once mixed, the wash composition 12 is encapsulated in the container, as described above. The components of the wash composition 12 may all be mixed at one time, or different components may be pre-mixed and then combined. A wide variety of mixers 60 may be used in alternate embodiments, such as an agitator, an in-line mixer, a ribbon blender, an emulsifier, and others. The wash composition 12 is placed in a water soluble container formed from a water soluble or water dispersible film 14, and then the film 14 of the container is sealed with a sealer 62, where the sealer 62 may utilize heat, water, ultrasonic techniques, water and heat, pressure, or other techniques for sealing the container and forming the single dose pack 10.

Another exemplary embodiment is also directed to the use of a single dose pack 10 as described above in a cleaning process such as laundry and/or hard surface cleaning. In particular, an embodiment is directed to the use of a single dose pack 10 in laundering of textile and fabrics, such as house hold laundry washing and industrial laundry washing. A further exemplary embodiment is directed to the use of a single dose pack 10 in hard surface cleaning such as automated Dish Washing (ADW), car washing, and the cleaning of industrial surfaces.

The fabrics and/or garments subjected to a washing, cleaning or textile care processes contemplated herein may be conventional washable laundry, such as household laundry. In some embodiments, the major part of the laundry is garments and fabrics, including but not limited to knits, woven fabrics, denims, non-woven fabrics, felts, yarns, and toweling. The fabrics may be cellulose based such as natural cellulosics, including cotton, flax, linen, jute, ramie, sisal or coir or manmade cellulosics (e.g., originating from wood pulp) including viscose/rayon, ramie, cellulose acetate fibers (tricell), lyocell or blends thereof. The fabrics may also be non-cellulose based such as natural polyamides including wool, camel, cashmere, mohair, rabbit, and silk, or the fabric may be a synthetic polymer such as nylon, aramid, polyester, acrylic, polypropylene and spandex/elastin, or blends of any of the above-mentioned products. Examples of blends are blends of cotton and/or rayon/viscose with one or more companion material such as wool, synthetic fibers (e.g., polyamide fibers, acrylic fibers, polyester fibers, polyvinyl alcohol fibers, polyvinyl chloride fibers, polyurethane fibers, polyurea fibers, aramid fibers), and cellulose-containing fibers (e.g., rayon/viscose, ramie, flax, linen, jute, cellulose acetate fibers, lyocell).

In one embodiment, the fabrics and/or garments are added to a washing machine, and the single dose pack 10 is also added to the washing machine before wash water is added. In an alternate embodiment, the single dose pack 10 may be added to an automatic detergent addition system of a washing machine, where the contents of the single dose pack 10 are added to the wash water with the fabrics and/or garments after the washing process has begun. In yet another embodiment, the single dose pack 10 is manually added to the fabrics and/or garments with the wash water after the washing process has started. The film 14 dissolves and releases the wash composition 12 into the aqueous wash water. The film 14 is dissolved and washes out of the washing machine with the excess wash water, so there is nothing to collect from the fabrics and/or garments after the wash cycle. The fabrics and/or garments are laundered with the wash water and the contents of the single dose pack 10. The fabrics and/or garments may then be dried and processed as normal.

In an alternate embodiment, the single dose pack 10 is added to a detergent charging system for an automatic dish washing machine. The detergent charging system opens and releases the single dose pack 10 to the wash water and a main compartment of the dish washing machine at a designated point in the wash cycle.

EXAMPLES

Propylene glycol 24, glycerol 20, and polyethylene glycol as the 4C+ compound 22 were utilized as the three components of the non-aqueous solvent 18 in a series of tests to determine usability of the non-aqueous solvent mixtures for the single dose pack 10. The wash composition 12 for all the tests also included: a C12-C15 alcohol ethoxylate as a nonionic detergent surfactant 32 present in an amount of about 23 weight percent; water 16 present in an amount of about 8 weight percent, where additional water 16 was added as components of other ingredients as indicated below; an optical brightener 44 present in an amount of about 0.2 weight percent; a bittering agent 50 present in an amount of about 0.05 weight percent; an ionic detergent surfactant 30 present in an amount of about 22 weight percent, where the ionic detergent surfactant 30 is about 60% active; 50 percent sodium hydroxide in water as a neutralizer 42, where the sodium hydroxide solution was present in an amount of about 0.28 weight percent; triethanol amine as a neutralizer 42 present in an amount of about 1.4 weight percent, where water is present in the triethanol amine in an amount of about 15 weight percent based on the total weight of the triethanol amine; coconut fatty acids as a foam inhibitor 46 present in an amount of about 4 weight percent; a polymer present in an amount of about 2 weight percent; an enzyme 34 present in an amount of about 1.6 weight percent; and a non-aqueous solvent 18 mixture present in an amount of about 37 weight percent, where the weight percents are based on the total weight of the wash composition 12. The non-aqueous solvent 18 mixture included one or more of propylene glycol 24, glycerol 20, and polyethylene glycol as the 4C+ compound 22.

Table 1 below lists test results for seven test runs, where the test runs had different compositions for the non-aqueous solvent 18. Table 1 lists the percentages of propylene glycol 24, glycerol 20, and polyethylene glycol (used as the 4C+ compound 22) based on the total quantity of non-aqueous solvent 18, where the "non-aqueous solvent" 18 as used for the examples herein includes one, two or three components selected from the propylene glycol 24 (abbreviated PG), glycerol 20 (abbreviated GLY), and polyethylene glycol (abbreviated PEG), where the polyethylene glycol is the 4C+ compound 22 tested in the test runs. The polyethylene glycol used was PEG 400, which has a number average molecular weight of about 400. The seven test runs were tested for viscosity (abbreviated Vis), water activity (abbreviated W.A.), swelling ratio (abbreviated S.R.), elastic modulus (abbreviated E.M), and % dissolution (abbreviated % Dis.).

The % dissolution was consistently determined by a repeatable test. The % dissolution test uses three 1 inch (")×3" (2.5 centimeter (cm)×7.6 cm) strips of PvOH film that are prepared and weighed. They are then arranged in a 10 cm diameter petri dish and test liquid is poured over them until completely submerged. The lid is placed on the dish, and the system is allowed to equilibrate for approximately 24 hours. The strips are then removed from the dish, and excess liquid is wiped off using kimwipes. The strips are added to a 600 milliliter (mL) beaker containing 400 mL water at 70 F (21° C.), and a 1 inch (2.54 cm) T-style stir bar at 400 revolutions per minute (RPM) and are stirred for 2 minutes. The mixture is then filtered over a Buchner funnel through a pre-weighed piece of filter paper, and the filter paper is allowed to dry overnight. The filter paper is re-weighed, and the % dissolution=residue/initial film weight. The swelling ratio was also determined by a consistent, repeatable test. The swelling ratio test uses three 1"×3" (2.5 cm×7.6 cm) strips of PvOH film that are prepared and each strip weighed individually. They are then arranged in a 10 cm diameter petri dish and test liquid is poured over them until completely submerged. The lid is placed on the dish, and the system is allowed to equilibrate for approximately 24 hours. The strips are then removed from the dish, and excess liquid is wiped off using kimwipes. The strips are then re-weighed. The swelling ratio is s=(final weight−initial weight)/initial weight. The elastic modulus is also determined by a consistent, repeatable test using three 1"×3" (2.5 cm×7.6 cm) strips of PvOH film that are prepared. The strips are then arranged in a 10 cm diameter petri dish and test liquid is poured over them until completely submerged. The lid is placed on the dish, and the system is allowed to equilibrate for approximately 24 hours. The strips are then removed from the dish, and excess liquid is wiped off using kimwipes. The strips are then individually loaded onto a Tinius Olsen™ tensiometer equipped with a 250 newton (N) load cell and pneumatic grips positioned 1.5" (3.8 cm) apart. The strips then undergo three 2 mm stretches, and the force/distance curve is recorded for each stretch. The slope (in N/mm) is recorded for each stretch. The average slope of all curves generated is the value reported.

The viscosity was generally desired to have values of 200 centipoise or less, where viscosity was determined as described above. The water activity was measured for informational purposes, but no desired value was specifically defined. The swelling ratio was generally desired to have values of about 0.3 or more, where swelling ratio was determined as described above. The elastic modulus (in neutrons per millimeter) was generally desired to have values of 0.9 or less, where elastic modulus was determined as described above. Finally, the percent dissolution was generally desired to have values of 80 or less, where percent dissolution was determined as described above. The combination of the three components of the non-aqueous solvent 18 are within limited ranges to most effectively limit aqueous solubility issues for water 16 within the wash composition 12.

TABLE 1

NON-AQUEOUS SOLVENT COMPOSITION AND TEST RESULTS

| Test run | PG | GLY | PEG | Vis | W.A. | S.R | E.M. | % Dis. |
|---|---|---|---|---|---|---|---|---|
| 1 | 0 | 100 | 0 | 533 | 0.556 | 0.603 | 0.51 | 96.6 |
| 2 | 50 | 0 | 50 | 125 | 0.646 | 0.112 | 1.23 | 99.4 |
| 3 | 0 | 0 | 100 | 179 | 0.685 | 0.023 | 2.59 | 78.1 |
| 4 | 0 | 50 | 50 | 300 | 0.608 | 0.199 | 1.26 | 75.2 |
| 5 | 50 | 50 | 0 | 211 | 0.581 | 0.467 | 0.51 | 98.6 |
| 6 | 33 | 33 | 33 | 197 | 0.609 | 0.235 | 0.88 | 89.6 |
| 7 | 100 | 0 | 0 | 91 | 0.610 | 0.307 | 0.59 | 94.4 |

Additional tests results compared wash compositions 12 with different concentrations of the non-aqueous solvents 18. As shown in Table 2, single dose packs 10 without polyethylene glycol (used as the C4+ compound 22, samples A-D) had significantly reduced pack heights (abbreviated P.H., measured in inches) compared to the single dose packs 10 that included polyethylene glycol (samples E-H.)

All pack heights were originally 0.8 inches (2 cm) and the reported values for samples A-H were measured after 2 months at 24° C. and the reported value for sample I was measured after 1 month at 24° C., where the single dose packs 10 were formed using Monosol® M8312 polyvinyl alcohol film in a single chamber containing 20 grams of wash composition 12. Height of the single dose pack 10 was measured by Ames® Logic Basic Digital Comparator Model BG1110-1-04, on a column mounted indicator, model 99-0697. Height of the sample was measured by placing the single dose pack 10 under the digital indicator, after the scale was zeroed. The weight percent of the various components are all based on the total weight of the wash composition 12, where the bittering agent 50 was added at 25% active; alcohol ethoxysulfates was added at 60% actives; and the anti-redeposition agents 40 were added at 44% actives. The nonionic detergent surfactant 32 was an alcohol ethoxylate with from about 12 to about 15 carbon atoms and about 7 ethylene oxide units. The alcohol ethoxysulfates used included about 12 to 14 carbon atoms and about 3 ethylene oxide unit. A total water 16 was calculated by combining the added water with the water present in other ingredients, and this is provided at the bottom of the table for informational purposes. PEG 3350, the polyethylene glycol used in sample I, has a number average molecular weight of about 3,350 Daltons.

TABLE 2

COMPARATIVE TESTS FOR VARYING NON-AQUEOUS SOLVENT COMPOSITIONS

| Sample | A | B | C | D | E | F | G | H | I |
|---|---|---|---|---|---|---|---|---|---|
| Pack Height (in) | 0.305 | 0.33 | 0.345 | 0.33 | 0.76 | 0.73 | 0.75 | 0.74 | 0.8 |
| Added water % | 9.68 | 8.309 | 12.15 | 4.39 | 8 | 10 | 10 | 12 | 10 |
| Nonionic Detergent % | 23.074 | 23.074 | 23.074 | 23.074 | 23.07 | 23.07 | 23.07 | 23.07 | 23.07 |
| Propylene Glycol % | 12.402 | 17.814 | 14.403 | 17.45 | 8 | 8 | 8 | 8 | 8 |
| Glycerin % | 18.444 | 14.403 | 13.974 | 18.686 | 9.7 | 9.7 | 10.36 | 10.36 | 9.7 |
| Polyethylene Glycol 400% | 0 | 0 | 0 | 0 | 10.25 | 8 | 16.43 | 14.16 | 8 (PEG 3350) |
| Bittering Agent % | 0.05 | 0.05 | 0.05 | 0.05 | 0.05 | 0.05 | 0.05 | 0.05 | 0.05 |
| alcohol ethoxysulfates % | 26 | 26 | 26 | 26 | 24 | 24 | 23 | 23 | 24 |
| Coconut Fatty Acid % | 4 | 4 | 4. | 4 | 4 | 4 | 4 | 4 | 4 |
| Anti Redeposition Agent % | 1.5 | 1.5 | 1.5 | 1.5 | 4 | 4 | 2 | 2 | 4 |
| Enzymes % | 2.55 | 2.55 | 2.55 | 2.55 | 2.45 | 2.45 | 1.5 | 1.5 | 2.45 |
| Other Ingredients % | 2.3 | 2.3 | 2.3 | 2.3 | 6.48 | 6.73 | 1.59 | 1.86 | 6.73 |
| Total Water % | 17.2 | 15.8 | 19.6 | 11.9 | 18 | 19.7 | 17.6 | 19.5 | 19.7 |

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the subject matter in any way. Rather, the foregoing detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A single dose pack comprising:

a water-soluble container formed from a water-soluble or water-dispersible film;

a wash composition encapsulated within the container, wherein the wash composition is in liquid form and comprises:

an ionic detergent surfactant present in an amount of from about 5 to about 55 weight percent, based on a total weight of the wash composition;

and solvents comprising:

(i) water present in an amount of from about 5 to about 20 weight percent based on the total weight of the wash composition;

(ii) a non-aqueous solvent combination comprising: glycerol present in an amount of from about 7 to about 26 weight percent, based on the total weight of the wash composition;

polyethylene glycol present in an amount of from about 8 to about 29 weight percent, based on the total weight of the wash composition wherein the polyethylene glycol has a number average molecular weight of from about 100 to about 10,000 Daltons; and propylene glycol present in an amount of from about 1 to about 14 weight percent of the wash composition, wherein the non-aqueous solvent combination comprises no additional non-aqueous solvent;

wherein the non-aqueous solvents, in total, are present in an amount of least 1.5 times the amount of the water;

wherein the solvents dissolve other components in the wash composition;

wherein the single dose pack has a percent pack height loss of about 25% or less when stored for about 2 months at a temperature of about 25 degrees Celsius; and wherein the wash composition has a viscosity of from about 100 to about 1,000 centipoise at a temperature of 25 degrees Celsius.

2. The single dose pack of claim 1 wherein the wash composition comprises:

the glycerol present in an amount of from 9.7 to 10.36 weight percent, based on the total weight of the wash composition;

the polyethylene glycol present in an amount of from 8 to 16.43 weight percent, based on the total weight of the wash composition.

3. The single dose pack of claim 2 wherein the wash composition comprises:

the propylene glycol present in an amount of 8 weight percent based on the total weight of the wash composition.

4. The single dose pack of claim 1 wherein the film comprises polyvinyl alcohol.

5. The single dose pack of claim 3, wherein the wash composition further comprises a nonionic detergent in an amount of 23 weight percent a bittering agent in an amount of 0.05 weight percent an alcohol ethoxysulfate in an amount of from 23 to 24 weight percent a coconut fatty acid in an amount of 4 weight percent an anti-redeposition agent in an amount of from 2 to 4 weight percent an enzyme in an amount of 1.5 to 2.5 weight percent and water in an amount of 17 to 20 weight percent, and wherein the single dose pack has the percent pack height loss of 8.8% or less when stored for about 2 months at a temperature of about 25 degrees Celsius.

6. The single dose pack of claim 1 wherein the wash composition further comprises:

an optical brightener present in an amount of from about 0.005 to about 5 weight percent, based on the total weight of the wash composition;

a nonionic detergent surfactant present in an amount of from about 5 to about 50 weight percent, based on the total weight of the wash composition; and an enzyme present in an amount of from about 0.001 to about 5 weight percent, based on the total weight of the wash composition.

7. The single dose pack of claim 1 wherein the single dose pack has the percent pack height loss of 8.8% or less when stored for about 2 months at a temperature of about 25 degrees Celsius.

8. A single dose pack comprising:

a water-soluble container formed from a water-soluble or water-dispersible film, wherein the film comprises polyvinyl alcohol;

a wash composition encapsulated within the container, wherein the wash composition is in liquid form and comprises:

an ionic detergent surfactant present in an amount of from about 5 to about 55 weight percent, based on a total weight of the wash composition;

and solvents comprising:

water present in an amount of from about 5 to about 20 weight percent based on the total weight of the wash composition; and a non-aqueous solvent consisting of polyethylene glycol, wherein the polyethylene glycol has a number average molecular weight of from about 100 to about 10,000 Daltons, glycerol, and propylene glycol, wherein the wash composition comprises the polyethylene glycol in an amount of from 8 to 16.43 weight percent, propylene glycol in an amount of 8 weight percent, and the glycerol in an amount of 9.7 to 10.36 weight percent, based on the total weight of the wash composition;

wherein the non-aqueous solvent, in total, is present in an amount of least 1.5 times a concentration of the water, in weight percent based on the total weight of the wash composition;

wherein the solvents dissolve other components in the wash composition;

wherein the single dose pack has a percent pack height loss of about 25% or less when stored for about 2 months at a temperature of about 25 degrees Celsius;

wherein the wash composition has a viscosity of from about 100 to about 1,000 centipoise at a temperature of 25 degrees Celsius.

9. The single dose pack of claim 8 wherein the wash composition further comprises:

an optical brightener present in an amount of from about 0.005 to about 5 weight percent, based on the total weight of the wash composition;

a nonionic detergent surfactant present in an amount of from about 5 to about 50 weight percent, based on the total weight of the wash composition; and an enzyme present in an amount of from about 0.001 to about 5 weight percent, based on the total weight of the wash composition.

10. The single dose pack of claim 8 wherein:

the single dose pack has a percent pack height loss of 8.8% or less when stored for about 2 months at a temperature of about 25 degrees Celsius.

* * * * *